US008960391B2

(12) United States Patent
Roncato

(10) Patent No.: US 8,960,391 B2
(45) Date of Patent: Feb. 24, 2015

(54) SUITCASE WITH CONNECTION FOR A PARTITION MADE OF DOUBLE MATERIAL

(75) Inventor: Enrico Roncato, Campodarsego (IT)

(73) Assignee: Valigeria Roncato S.p.A., Campodarsego (PD) (IT)

( * ) Notice: Subject to any disclaimer, the term of this patent is extended or adjusted under 35 U.S.C. 154(b) by 0 days.

(21) Appl. No.: 13/983,628

(22) PCT Filed: Feb. 6, 2012

(86) PCT No.: PCT/EP2012/051939

§ 371 (c)(1), (2), (4) Date: Aug. 5, 2013

(87) PCT Pub. No.: WO2012/107389

PCT Pub. Date: Aug. 16, 2012

(65) Prior Publication Data

US 2013/0306421 A1 Nov. 21, 2013

(30) Foreign Application Priority Data

Feb. 7, 2011 (IT) ..... MI2011A0175

(51) Int. Cl.

| | |
|---|---|
| ***A45C 5/03*** | (2006.01) |
| ***A45C 5/02*** | (2006.01) |
| ***A45C 13/02*** | (2006.01) |
| ***A45C 13/10*** | (2006.01) |

(52) U.S. Cl.

CPC ... *A45C 5/03* (2013.01); *A45C 5/02* (2013.01); *A45C 13/02* (2013.01); *A45C 13/103* (2013.01); *A45C 2013/026* (2013.01); *Y10S 190/903* (2013.01)

USPC ..... 190/110; 190/109; 190/903

(58) Field of Classification Search

CPC ..... A45C 5/03

USPC ..... 190/109, 110, 903, 122, 124; 383/97; 24/381, 30.5 L, 589.1

See application file for complete search history.

(56) References Cited

U.S. PATENT DOCUMENTS

| | | | | | |
|---|---|---|---|---|---|
| 1,521,260 | A | * | 12/1924 | Trachtenberg | 190/108 |
| 2,758,682 | A | * | 8/1956 | Shwayder | 190/28 |
| 3,158,238 | A | * | 11/1964 | Kish, Jr. | 206/315.9 |
| 3,443,671 | A | * | 5/1969 | Dyke | 190/103 |
| 3,698,522 | A | * | 10/1972 | Aronoff | 190/126 |
| 5,168,968 | A | * | 12/1992 | Fritze | 190/28 |
| 5,394,315 | A | * | 2/1995 | Ahroni | 362/656 |
| 5,529,823 | A | * | 6/1996 | Aumann | 428/53 |
| 6,345,709 | B1 | * | 2/2002 | Cheng | 190/119 |
| 6,467,594 | B1 | * | 10/2002 | Wu | 190/108 |
| 7,143,878 | B2 | * | 12/2006 | Selvi | 190/103 |

FOREIGN PATENT DOCUMENTS

| | | |
|---|---|---|
| CA | 2 635 328 | 12/2009 |
| GB | 2 121 093 | 12/1983 |
| WO | WO 2010/038244 | 4/2010 |

* cited by examiner

*Primary Examiner* — Sue A Weaver
(74) *Attorney, Agent, or Firm* — Jacobson Holman, PLLC.

(57) ABSTRACT

A suitcase comprising a body with an edge adapted to be coupled to a space of a connection means for a partition adapted to divide the internal space of the suitcase into a smaller space and a larger space, the connection comprising a raceway adapted to be slidingly coupled to a sliding element which is complementary to the raceway and fixed to a support element with which the partition is integrally associated, the connection includes an internal portion of the body made of soft material, at the extremity of which the raceway which is made of rigid material is fixed, and an external portion of the body made of soft material, the sliding element being made of rigid material fixed to the support element which is made of soft material.

4 Claims, 5 Drawing Sheets

SUITCASE WITH CONNECTION FOR A PARTITION MADE OF DOUBLE MATERIAL

This is a national stage of PCT/EP12/051939 filed Feb. 6, 2012 and published in English, which has a priority of Italian no. MI2011A000175 filed Feb. 7, 2011, hereby incorporated by reference.

BACKGROUND OF THE INVENTION

1. Field of the Invention

The present invention concerns a suitcase with a connection for a partition made of double material.

The existence of suitcases with partition sheets between the superior part and the inferior part of the suitcase in order to separately house rather incompatible objects such as shoes and items of clothing is known on the market.

Said partitions are usually made of fabric and must be supported by the edge of the superior or inferior shell of the body of the suitcase. The connection to said edge usually occurs by means of stitching, together with the body, to a profile adapted to "wrap up" said edge of the body and the edge of the partition. More precisely, said connection profile comprises an internal portion of the body connected to an external portion of the body. The stitching passes through said two portions in addition to the body and the partition therebetween. Said profile further comprises a further external portion adapted to cover the stitching. Between said two external portions, the edge of an external zip can be provided, which is also stitched to the body by means of the same line of stitching.

The partition is thus irreversibly integral with the body, an internal zip usually being provided to access the superior or inferior space of the suitcase. However, the partition cannot be removed from the suitcase.

2. Background Art

GB-2121093 describes a raceway-like connection integral with the body of the suitcase which can be coupled with an element integral with the partition by means of a complementary profile inertable into said raceway. Said couplable elements are extruded from plastic material of the same type. Disadvantageously, the raceway requires a deformable portion to connect the external zip in view of a remarkable rigidity required to couple the rigid body of the suitcase and the support of the partition which would otherwise not slide into the raceway. Consequently, as the deformable part is made of the same material as the portion to be connected to the body, it tends to break because it is too rigid for the intended purpose.

BRIEF SUMMARY OF THE INVENTION

The object of the present invention is to provide a suitcase with a connection means for connecting the partition to the body, which is simple and cost-effective to be provided, and more flexible and durable as compared to prior art.

According to the invention, this object is achieved by a suitcase comprising a body with an edge adapted to be coupled to a space of connection means for a partition adapted to divide the space inside the suitcase into an inferior space and a superior space, said connection means comprising a raceway adapted to be slidingly coupled to a sliding element which is complementary to the raceway and fixed to a support element with which the partition is integrally associated, characterized in that said connection means includes an internal portion of the body made of soft material, at the extremity of which the raceway made of rigid material is fixed, and an external portion of the body made of soft material, the sliding element being made of a rigid material fixed to the support element made of soft material.

BRIEF DESCRIPTION OF THE DRAWINGS

These and other features of the present invention will become more apparent from the following detailed description of a practical embodiment thereof, shown by way of non-limiting examples in the accompanying drawings, in which.

DETAILED DESCRIPTION OF THE INVENTION

Figure 1:
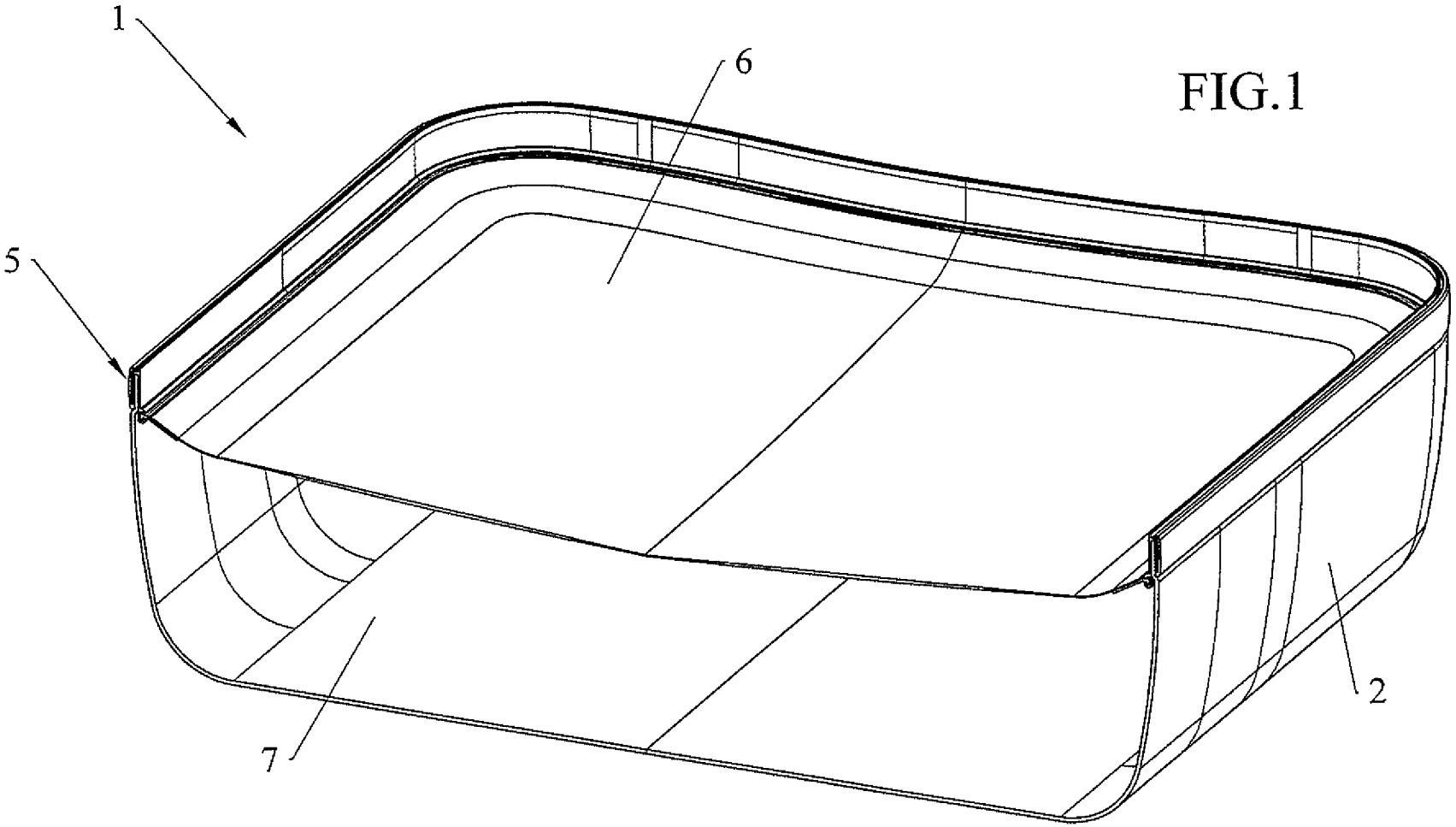
FIG. 1 shows a perspective view of a conveniently cut suitcase according to the present invention.
Figure 2:
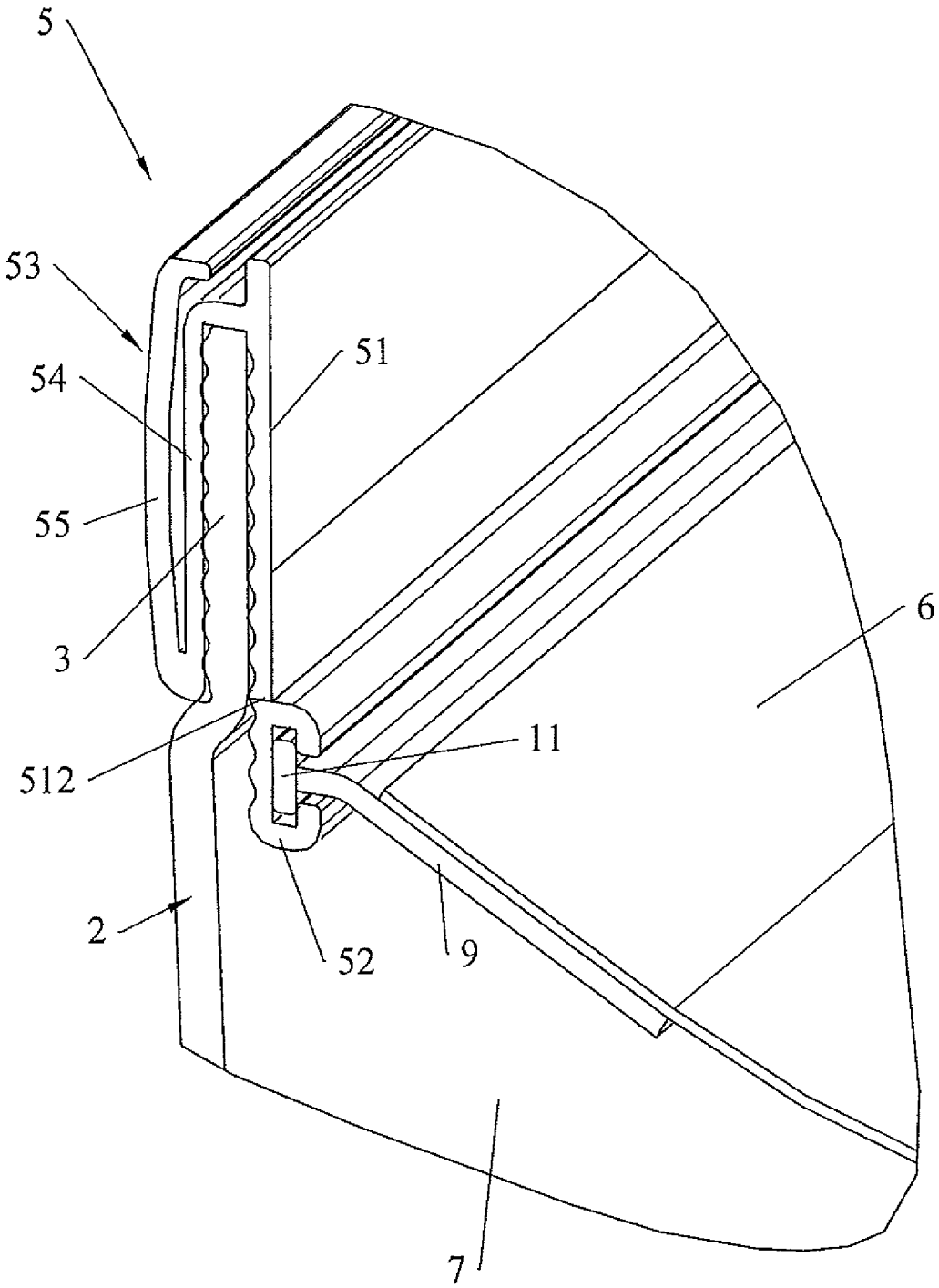
FIG. 2 shows an enlarged perspective view of a body-partition connection.
Figure 3:
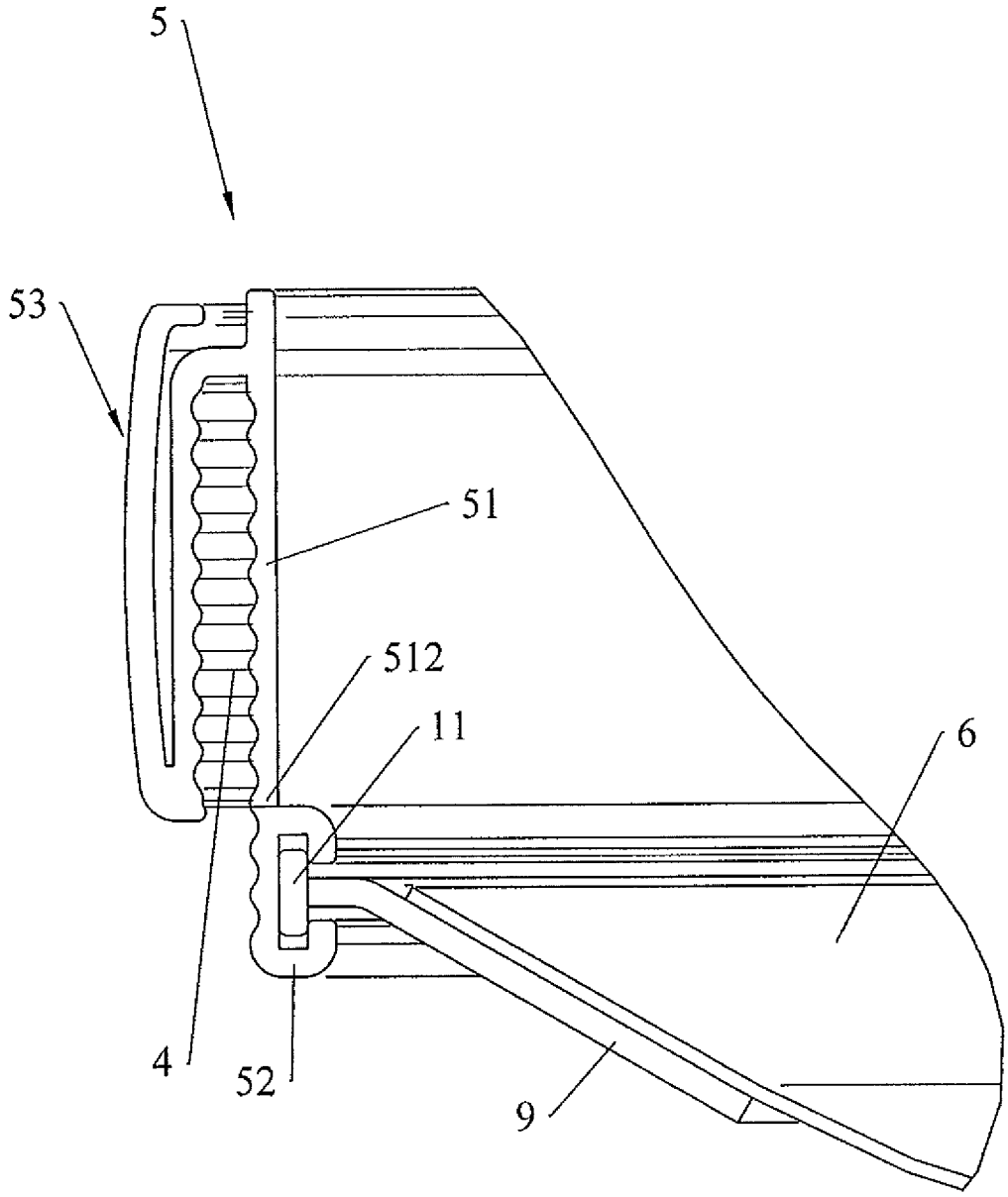
FIG. 3 shows an enlarged perspective view of the connection without the body.
Figure 4:
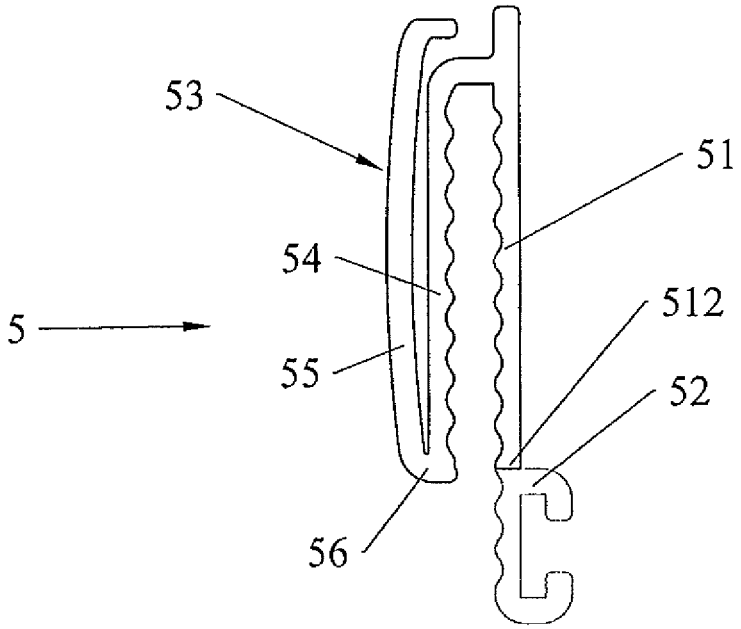
FIG. 4 shows a vertical section view of the connection only.

A suitcase 1 comprises a rigid inferior body 2 with an edge 3 adapted to be coupled to a space 4 of a connection means 5 for a partition 6 adapted to divide the internal space of suitcase 1 into an inferior space 7 and a superior space 8.

The connection means 5 includes an internal portion 51, to the extremity 512 of which a raceway 52 is glued, adapted to be coupled to a sliding element 11 connected by gluing to a support element 9 with which a partitioning layer 6 is integrally associated. An internal zip 13 can be associated with partition 6.

Partition 6 is made of fabric, for example, and is stitched to element 9, for example; or it can be glued thereto 9.

Internal portion 51 is made of soft plastic material, for example soft thermoplastic material such as PVC, TPE and PP, or rubber. Soft plastic material means a plastic material with a Shore A hardness, for example, and by rigid plastic material means a plastic material with a Shore D hardness, for example. Raceway 52 is made of rigid plastic material, e.g. rigid polypropylene, as well as the sliding element 11; support element 9 is made of soft plastic material. Rigidity is fundamental because otherwise element 11 would not slide into raceway 52.

The connection means 5 further comprises a deformable external portion 53 made of soft material, such as soft PVC or rubber, which includes a first portion 54 facing said internal portion 51 to form the space 4 adapted to lodge the edge 3 of body 2, and a second portion 55 facing said first portion 54 and integrally in one piece therewith: a deformable link portion 56 ensures the mobility of said second portion 55 with respect to said first portion 54.

First portion 54 is secured to body 2 by means of stitching, for example, as well as the fabric edge of an external zip 12.

The external portion 53 of the connection means 5 consists of a single piece made of deformable rubbery material, and is integral with internal portion 51. Consequently, connection means 5 consists of external 53 and internal 51 portions made of a soft material which is suitable to deform in order to facilitate the connection, for example by means of stitching to the body, and of a rigid raceway 52 which can be coupled to partition 6 being glued to the inferior extremity 512 of the internal portion 51. A single line of stitching makes the internal portion 51, the body 2, the first portion 54 of external portion 53 and the external zip 12 integral with one another.

Figure 5:
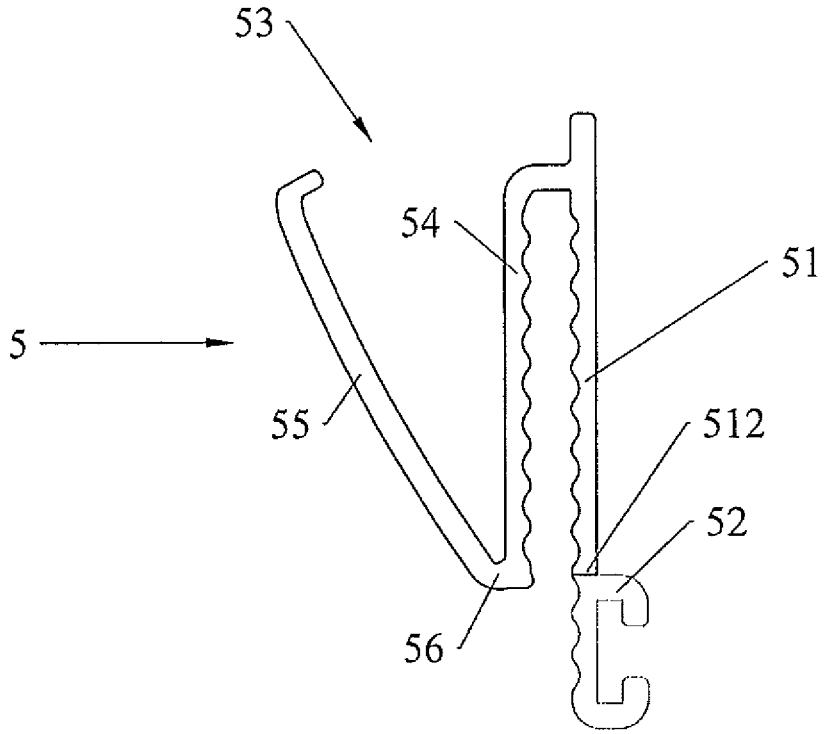
FIG. 5 shows a vertical section view of the connection only with a bent external portion.
Figure 6:
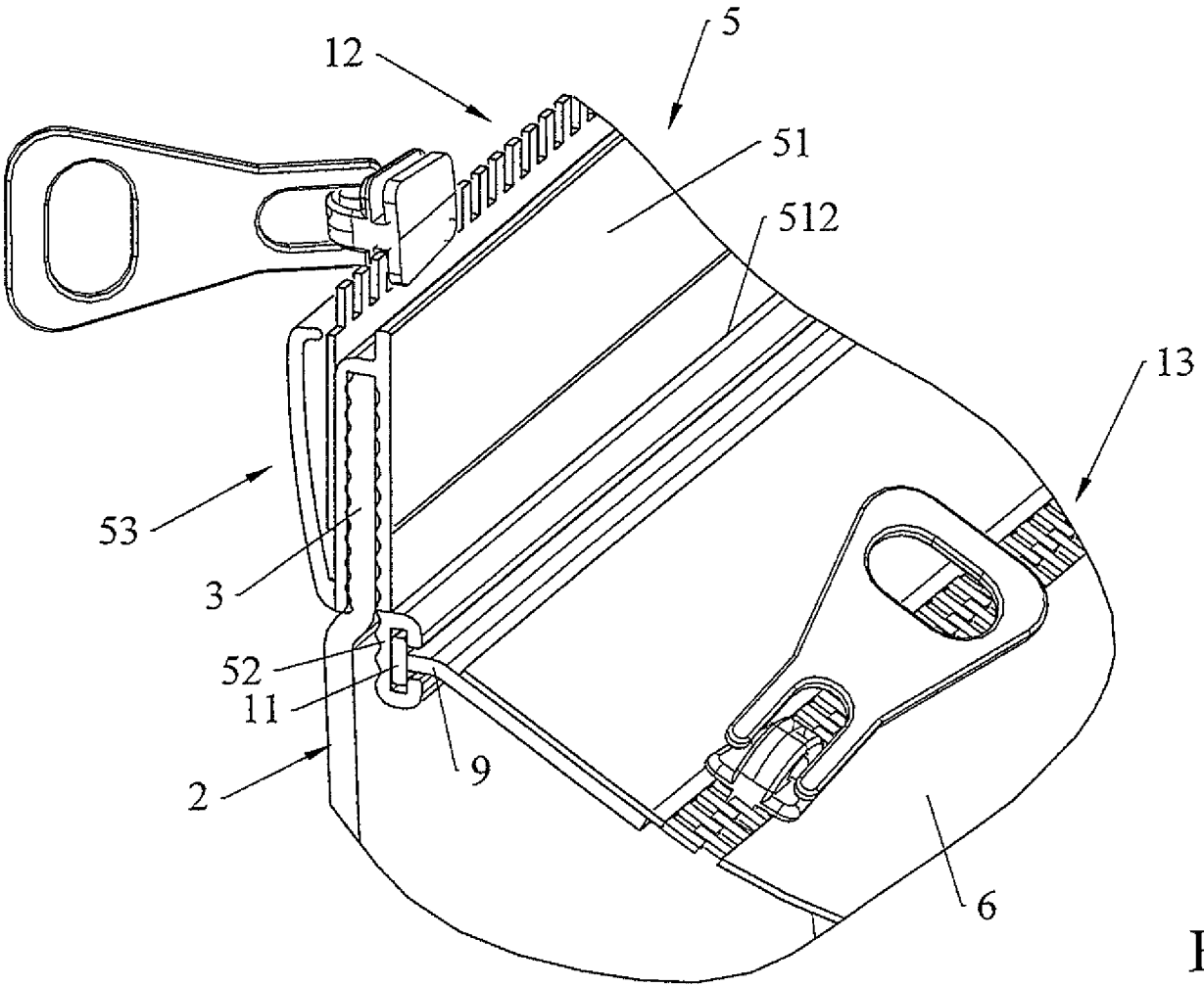
FIG. 6 shows an enlarged perspective view of the connection with internal and external zips.

As shown in FIG. 5, the possibility to bend the second portion 55 with respect to the first portion 54 facilitates the operation of connecting the connection means 5 to body 2. Portion 55 being made of a rubbery material means that there is no risk of breakage during the bending operation; at the same time, the connection seal of partition 6 is ensured through the rigidity of the plastic material of raceway 52.

The rigidity of raceway 52 and slidable element 11, i.e. the parts intended to reciprocally slide, advantageously facilitates the assembling of partition 6, which is otherwise subject to annoying frictions of rubbery materials which slow down the assembly thereof and often cause breakages. Similarly, the remaining parts remain made of soft material, thus enhancing the overall elasticity of the connection.

The invention claimed is:

1. A suitcase comprising a body with an edge suitable to couple with a space of connection means for a partition suitable to divide the space inside a suitcase in an inferior space and a superior space, said connection means comprising a raceway suitable to couple slidingly with a sliding element complementary to the raceway and fixed to a support element to which the partition is integrally associated, wherein said connection means provide a soft material internal portion of the body to which extremity the raceway in rigid material is fixed, and a soft material external portion to the body, the slidable element being in rigid material fixed to the support element in soft material.

2. The suitcase according to claim 1, wherein said sliding element forms a "T" with the support element of the partition.

3. The suitcase according to claim 1, wherein the internal portion is a substantially vertical strip, and the raceway is fixed to said internal portion in such a way to be in vertical lying.

4. The suitcase according to claim 1, wherein the external portion provides a first portion facing said internal portion to form the space suitable to lodge the edge of the body, and a second portion facing said first portion and integer with it by means of a deformable link portion suitable to provide mobility to said second portion with respect to said first portion.

* * * * *